United States Patent [19]

Jan-Ove et al.

[11] Patent Number: 4,804,040

[45] Date of Patent: Feb. 14, 1989

[54] PLATE HEAT EXCHANGER

[75] Inventors: Bergqvist Jan-Ove, Malmö ; Nilsson Ebbe, Arlöv; Andersson Jarl, Lund, all of Sweden

[73] Assignee: Alfa-Laval Thermal AB, Tumba, Sweden

[21] Appl. No.: 153,831

[22] PCT Filed: Jul. 2, 1987

[86] PCT No.: PCT/SE87/00314

§ 371 Date: Jan. 19, 1988

§ 102(e) Date: Jan. 19, 1988

[87] PCT Pub. No.: WO88/00323

PCT Pub. Date: Jan. 14, 1988

[30] Foreign Application Priority Data

Jul. 9, 1986 [SE] Sweden ..... 8603059

[51] Int. Cl.[4] ..... F28F 3/08

[52] U.S. Cl. ..... 165/78; 165/166; 165/167; 29/157.3 R; 29/157.3 C

[58] Field of Search ..... 165/166, 167, 78; 16/87.2, 78, 93 D; 29/453, 157.3 R, 157.3 C; 403/391, 347, 346

[56] References Cited

U.S. PATENT DOCUMENTS

| | | | |
|---|---|---|---|
| 1,854,275 | 4/1932 | Rumpf et al. | 16/87.2 |
| 2,252,916 | 8/1941 | Crosby | 165/78 |
| 3,448,796 | 6/1969 | Usher | 165/78 |
| 3,526,337 | 9/1970 | Paxton | 16/87.2 X |
| 4,301,915 | 11/1981 | Michalik et al. | 403/391 X |

FOREIGN PATENT DOCUMENTS

| | | | |
|---|---|---|---|
| 1235278 | 5/1960 | Fed. Rep. of Germany | 16/87.2 |
| 46856 | 7/1966 | German Democratic Rep. | 165/78 |

*Primary Examiner*—Samuel Scott
*Assistant Examiner*—Carl D. Price
*Attorney, Agent, or Firm*—Davis Hoxie Faithfull & Hapgood

[57] ABSTRACT

The present invention relates to a kind of plate heat exchanger (1) comprising several heat exchange plates (2, 2D), which are arranged between a frame plate (3) and a pressure plate (4) and are supported by a lower carrying bar (7), said lower carrying bar (7) and an upper guiding bar (6, 6B) extending through recesses (18) in lower and upper parts, respectively, of the heat exchange plates (2, 2D), and at least the upper part of each heat exchange plate (2, 2D) being provided with at least one lug (19, 20) extending into the upper recess (18) and forming an upper constriction of it for retaining of the heat exchange plate (2, 2D) in position on the guiding bar (6, 6B), said lug being flexible enough to be bent aside to permit insertion of the guiding bar into the recess and to spring back after the bar has been inserted. According to the invention each heat exchange plate (2, 2D) is flexible enough in the area of said lug (19, 20) to allow the lug to be bent aside perpendicularly to the plane of the heat exchange plate (2, 2D), providing an opening for insertion of the guiding bar (6, 6B) into the recess (18), and to spring back after mounting of the plate in the plate heat exchanger (1).

1 Claim, 1 Drawing Sheet

PLATE HEAT EXCHANGER

BACKGROUND OF THE INVENTION

The present invention relates to a kind of plate heat exchanger comprising a bundle of several heat exchange plates, which are arranged between a frame plate and a pressure plate and are supported by a lower carrying bar, said lower carrying bar and an upper guiding bar extending through recesses in the lower and upper parts, respectively, of the heat exchange plates, and in particular to a plate heat exchanger in which at least the upper part of each heat exchange plate is provided with at least one lug extending into the upper recess and forming an upper constriction of said recess for retaining the heat exchange plate in position on said guiding bar.

Plate heat exchangers of this kind are common on the market. Generally, one would like to use bars having standard cross-sections, e.g. round bars, both for the lower carrying bar and the upper guiding bar. For this reason conventional heat exchange plates have been provided with U-shaped recesses in both their upper and lower parts. However, to prevent the plates from loosing engagement with the upper guiding bar and the bundle of plates falling apart during assembling or disassembling of the plate heat exchanger, one has been forced after placing of each plate in the heat exchanger to fasten a separately attached bracket on the plate to bridge the upper recess in the plate above the said guiding bar. Alternatively one has had to replace the round bars with specially formed beams cooperating with specially formed recesses in the heat exchange plates, as illustrated in U.S. Pat. No. 2,252,916 and British Pat. No. 1 129 924.

Both these arrangements have proved to be extremely expensive. Therefore, there has been a demand on the market for another solution to the problem as to how the heat exchange plates, while resting on the lower carrying bar, should be fixed relative to the upper guiding bar in order to prevent the bundle of plates from falling apart.

SUMMARY OF THE INVENTION

According to the present invention a solution to said problem is obtained by means of a plate heat exchanger of the type described, which is characterized in that each heat exchange plate is flexible enough in the area of the said lug to allow the lug to be bent aside perpendicularly to the plane of the heat exchange plate, providing an opening for insertion of the guiding bar into the recess, and to spring back after mounting of the plate in the plate heat exchanger.

By this invention the heat exchange plates may be easily assembled between the guiding bar and the carrying bar. Further, the guiding bar can be a cheap round bar or a bar having another cross-section, i.e. a square section.

Further features of the invention will appear in more detail from the following description of the invention with reference to the accompanying drawing, in which

DESCRIPTION OF THE PREFERRED EMBODIMENTS

Figure 1:
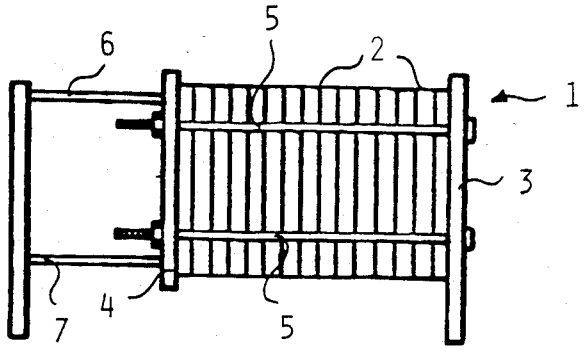
FIG. 1 shows a plate heat exchanger according to the invention.

Referring to FIG. 1 there is shown a plate heat exchanger 1 comprising several heat exchange plates 2, a frame plate 3 and a pressure plate 4. The heat exchange plates 2 are clamped between the frame plate 3 and the pressure plate 4 by means of fastening bolts 5. An upper guiding bar 6 and a lower carrying bar 7 extend through upper and lower parts respectively of the heat exchange plates 2. The heat exchange plates 2 rest on the lower carrying bar 7 and are supported thereby.

Figure 2:
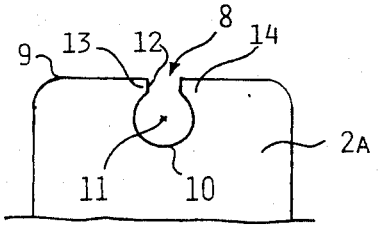
FIGS. 2–5 show four different embodiments of the upper part of a heat exchange plate for a plate heat exchanger according to the invention.

Referring to FIG. 2 there is shown a first embodiment of an upper part of a heat exchange plate 2A provided with an essentially circular recess 8 intended to admit attachment of the heat exchange plate 2A on a guiding bar (not shown). The recess 8 is located within the periphery 9 of the plate. A first part 10 of the recess 8 is formed like a circle, the centre 11 of the circle lying at a distance from the periphery 9 of the plate, which is greater than the radius of the circle. A second part 12 of the recess, extending from the plate periphery 9 and inwards to said circle, has a width less than the diameter of the circle. Two lugs 13, 14 are thus formed in the plate on the respective sides of the recess part 12.

Preferably the recess 8 is symmetrically located at both sides of a vertical center line of the plate.

It was stated above that the recess 8 was essentially circular, but instead of being circular the recess 8 could be oval or have another suitable form.

Figure 3:
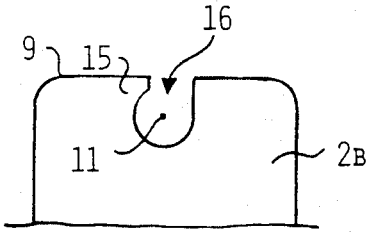

Referring to FIG. 3 there is shown a second embodiment of an upper part of a heat exchange plate 2B, which differs from the one according to FIG. 2 in that the heat exchange plate 2B only has one lug 15 extending into a recess 16.

Figure 4:
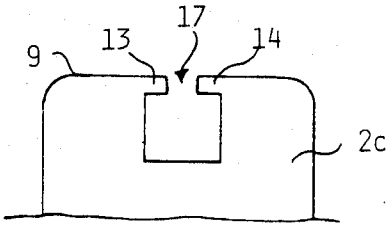

Referring to FIG. 4 there is shown a third embodiment of an upper part of a heat exchange plate 2C, which differs from the one according to FIG. 2 in that a recess 17 has an essentially square shape. The recess 17 is located symmetrically at both sides of a vertical centre line of the plate. Instead of being square the recess 17 could be in the form of an elongate rectangle.

Figure 5:
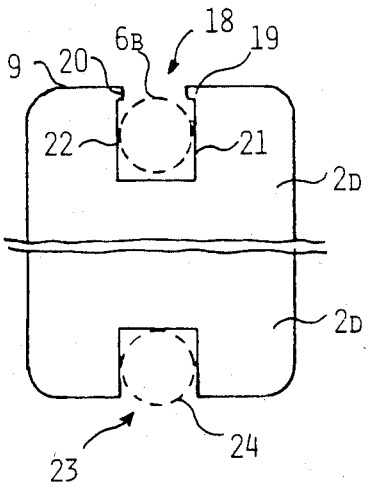

Referring to FIG. 5 there is shown a fourth embodiment of an upper and a lower part of a heat exchange plate 2D. The upper part has a recess 18 for a guiding bar 6B of circular cross-section (in the figure shown with dashed lines), which recess 18 is essentially square but could be rectangular. In the upper periphery part of the heat exchange plate 2D two lugs 19, 20 are formed opposite to each other, such that the distance between them is shorter than the distance between two vertical edges 21, 22 delimiting the recess 18. The distance between the lugs 19, 20 is also shorter than the diameter of the circular section of the guiding bar 6B. The lower part of the plate 2D has a U-shaped recess 23 for a carrying bar also of circular cross-section (in the figure shown with dashed lines). The heat exchange plate 2D is supported by said carrying bar.

During assembling of the plate on the guiding bar the lugs are bent sidewards in opposite directions perpendicularly to the plane of the heat exchange plate to make the assembly possible. The lugs are bent apart until the distance between them is sufficient for the insertion of the guiding bar into the recess. After the assembly the lugs will spring back and thus form an upper constriction of the recess, which will retain the heat exchange plate in position on the guiding bar.

A corresponding recess can be provided at the lower part of the heat exchange plate, which will retain the heat exchange plate in position on the carrying bar, but since the heat exchange plate is supported by the carrying bar a U-shaped recess will be sufficient.

We claim:

1. Plate heat exchanger comprising several heat exchange plates (2, 2A–D), which are arranged between a frame plate (3) and a pressure plate (4) and are supported by a lower carrying bar (7), said lower carrying bar (7) and an upper guiding bar (6, 6B) extending through recesses (8, 16, 17, 18) in lower and upper parts, respectively, of the heat exchange plates (2, 2A–D), and at least the upper part of each heat exchange plate (2, 2A–D) being provided with at least one lug (13, 14, 15, 19, 20) extending into the upper recess (8, 16, 17, 18) and forming an upper constriction of said recess for retention of the heat exchange plate (2, 2A–D) in position on said guiding bar (6, 6B), characterized in that each heat exchange plate (2, 2A–B) is flexible enough in the area of said lug (13, 14, 15, 19, 20) to allow the lug to be bent aside perpendicularly to the plane of the heat exchange plate (2, 2A–D), providing an opening for insertion of the guiding bar (6, 6B) into the recess (8, 16, 17, 18), and to spring back after mounting of the plate in the plate heat exchanger (1).

* * * * *